US006490815B1

(12) United States Patent
Pratt

(10) Patent No.: US 6,490,815 B1
(45) Date of Patent: Dec. 10, 2002

(54) EXCAVATOR BUCKET WITH RIPPING IMPLEMENT

(75) Inventor: Samuel S. Pratt, Bedford, PA (US)

(73) Assignee: Rockland, Inc., Bedford, PA (US)

( * ) Notice: Subject to any disclaimer, the term of this patent is extended or adjusted under 35 U.S.C. 154(b) by 0 days.

(21) Appl. No.: 09/495,590

(22) Filed: Feb. 1, 2000

(51) Int. Cl.[7] ..... E02F 3/96
(52) U.S. Cl. ..... 37/408; 37/404; 37/444
(58) Field of Search ..... 37/403, 404, 405, 37/409, 410, 443, 444, 408

(56) References Cited

U.S. PATENT DOCUMENTS 3,109,248 A * 11/1963 Vos ..... 37/117.5
4,531,883 A * 7/1985 Arnold ..... 414/722
5,456,028 A * 10/1995 Larson ..... 37/404
5,743,030 A * 4/1998 Sirr ..... 37/406

FOREIGN PATENT DOCUMENTS

FR 2706503 * 6/1994

* cited by examiner

*Primary Examiner*—Thomas B. Will
*Assistant Examiner*—Kristine Markovich
(74) *Attorney, Agent, or Firm*—Stevens, Davis, Miller & Mosher, LLP

(57) ABSTRACT

An excavating bucket mountable on the handle of an excavating machine generally consisting of a pair of side walls; an upper wall interconnecting such side walls; a downwardly and forwardly curved rear wall merging into a forwardly curved bottom wall, interconnecting such side walls and providing a transversely disposed cutting edge; at least one ripping tooth mounted on the rear wall, projecting rearwardly and having a curved lower edge merging with the curvature of the rear and bottom walls to provide a substantially continuous curved line; and mounting brackets for detachably connecting to the bucket to the handle of the machine.

30 Claims, 4 Drawing Sheets

EXCAVATOR BUCKET WITH RIPPING IMPLEMENT

This invention relates to an excavator or material handling bucket mountable on the handle of an excavator or material handling bucket of an excavating machine and the like, and more particularly to such a bucket provided with an implement for penetrating and fracturing hard surfaces being excavated or otherwise removed.

BACKGROUND OF THE INVENTION

In most excavating or material removal operations involving the use of a conventional bucket, the cutting edges of the bucket normally are sufficient to penetrate the material being excavated or otherwise removed. When the surfaces of such materials may be too hard to be penetrated by such cutting edges, it has been the conventional practice to break up such hard surfaces by means of the use of a ripping implement typically consisting of a pointed tool capable of penetrating and fracturing hard ground or structural surfaces. Such implements typically have consisted of separate, dedicated implements mountable on the handles of excavating machines and the like or components of buckets mountable on such handles.

In the prior art, there are many buckets equipped with ripping teeth or scarifiers used for penetrating and breaking up hard surfaces being excavated or otherwise handled. The designs of such prior art implements, however, have not been found to be entirely satisfactory and effective, facilitating their use and thus providing improved productivity. It thus is the principal object of the present invention to provide a bucket mountable on the handle of an excavating machine and the like for the excavating or otherwise handling materials having hard surfaces, provided with improved means for penetrating and fracturing such hard surfaces and thus increasing the productivity of such buckets.

SUMMARY OF THE INVENTION

The present invention provides a bucket mountable on the handle of an excavating machine and the like, having means capable of penetrating and fracturing hard surfaces of materials being excavated or otherwise handled, generally consisting of a pair of side walls; an upper wall interconnecting the side walls; a downwardly and forwardly curved rear wall merging into a forwardly curved bottom wall interconnecting the side walls and providing a transversely disposed cutting edge; at least one ripping tooth mounted on the rear wall, projecting rearwardly and having a curved lower edge merging with the curvature of the rear and bottom walls to provide a substantially continuous curved line; and means for detachably connecting the bucket to the handle of the machine. Preferably, the lower edge of the ripping tooth and a portion of the rear and bottom walls of the bucket have the same radius of curvature, and such tooth is provided with a curved upper cutting edge. Either a single ripping tooth or a pair of ripping teeth may be used. In embodiments using a pair of longitudinally disposed, transversely spaced brackets for detachably connecting the bucket to the handle of the machine, and a pair of longitudinally disposed, transversely spaced ripping teeth, such teeth preferably are disposed adjacent to or aligned with such mounting brackets and adjacent to the side walls of the bucket to effectively transmit loads between the mounting brackets and the ripping teeth.

DESCRIPTION OF THE PREFERRED EMBODIMENTS OF THE INVENTION

Figure 1:
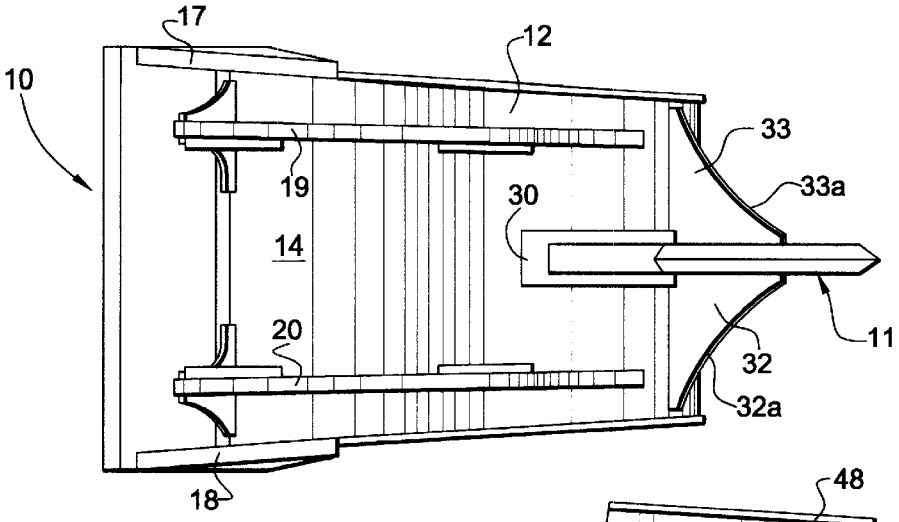
FIG. 1 is a top plan view of an embodiment of the invention.
Figure 2:
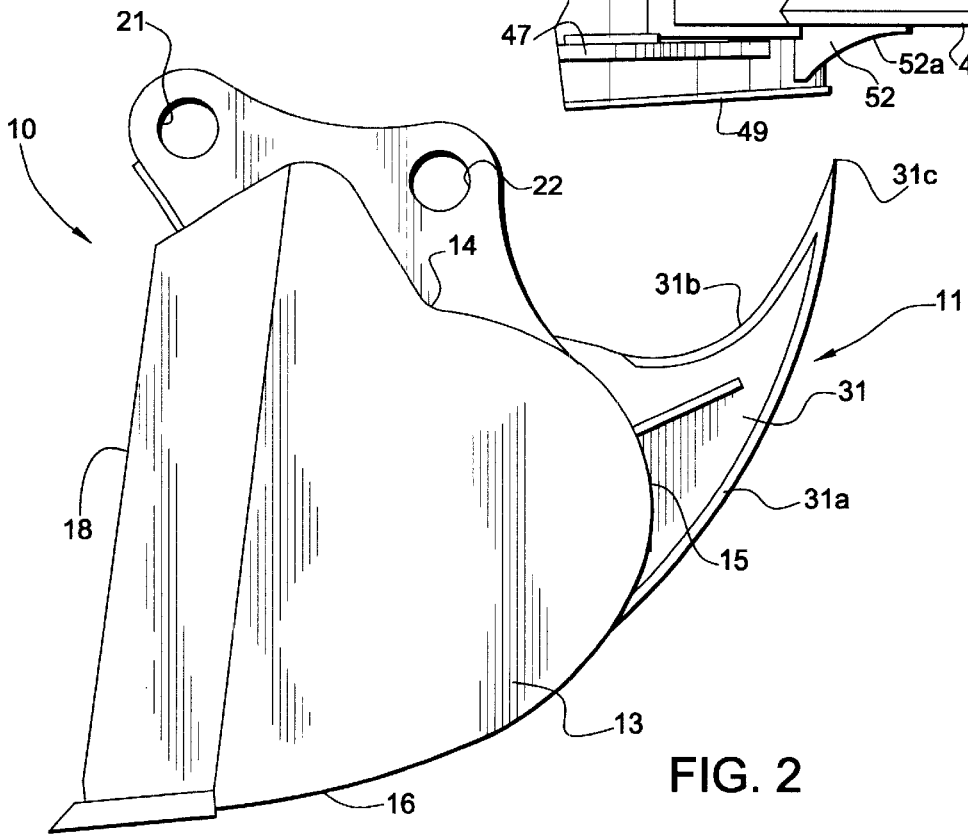
FIG. 2 is a side elevational view of the embodiment shown in FIG. 1.

Referring to FIGS. 1 and 2 of the drawings, there is illustrated a first embodiment of the invention which includes a bucket 10 equipped with a single ripping implement 11. The bucket includes a pair of longitudinally disposed, transversely spaced side walls 12 and 13, an upper wall 14, a curved rear wall 15 and a curved bottom wall 16. The side walls are substantially parallel, converging slightly toward the rear wall and are provided with a pair of forwardly disposed cutting edges 17 and 18. Upper wall 14 rigidly interconnects the upper ends of side walls 12 and 13 and is provided with a pair of longitudinally disposed, transversely spaced mounting brackets 19 and 20. Such brackets are positioned adjacent side walls 12 and 13 are provided with a first set of transversely aligned openings 21, 21 and a second set of transversely aligned openings 22, 22 for detachably connecting the bucket to the handle of the machine as later will be described. Rear wall 15 forms a continuation of the rear end of the upper wall and is provided with a curvature which mergers smoothly with the curvature of the lower wall.

Ripping implement 11 is rigidly secured to rear wall 15 and is disposed in a vertical plane passing through the centerline of the bucket and spaced equidistantly from the side walls of the bucket. The implement includes a base section 30, a projecting section 31 and a pair of reinforcing plates 32 and 33. Base section 30 comprises a curved plate member having a radius of curvature complementary to a portion of rear wall 15 and is rigidly secured to the rear wall preferably by welding. Section 31 is rigidly secured to base section 30 and projects rearwardly of the rear wall. It has a tooth-like configuration including a lower curved edge 31*a* and an upper curved edge 31*b* converging at a point 31*c*. Lower edge 31*a* has a radius of curvature similar to the radius of curvature of a portion of the rear and bottom walls of the bucket so that such lower edge merges continuously with such portion with the bucket. Edges 31*a* and 31*b* also are sharpened to enhance the penetrating action of the implement. Reinforcing plates 32 and 33 are rigidly secured, preferably by welding, to the sides of tooth-like section 31 and to rear wall 15, as best shown in FIG. 1. Rearwardly facing edges 32*a* and 32*a* thereof are concavely curved to further enhance the penetrability of tooth-like section 31.

Figure 1A:
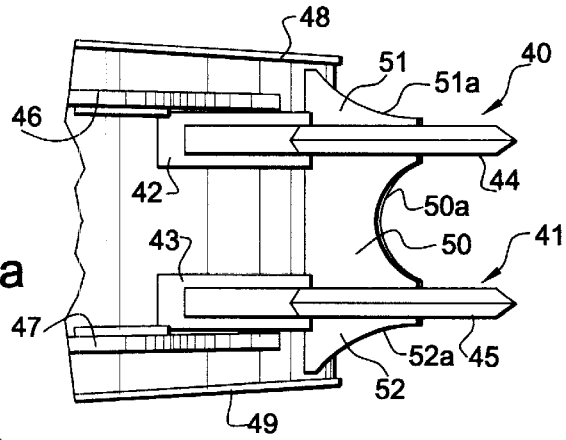
FIG. 1*a* is a top plan view of a modification of the embodiment shown in FIG. 1, having a portion thereof broken away.

The embodiment shown in FIG. 1*a* is similar to the embodiment shown in FIGS. 1 and 2 with the exception of providing a pair of longitudinally disposed, transversely spaced implements 40 and 41. Each of such implements is similar to implement 11 in being provided with base sections 42 and 43 comparable to base section 30 and tooth-like sections 44 and 45 comparable to tooth section 31. Implements 40 and 41 are secured to the rear wall of the bucket adjacent mounting brackets 46 and 47 comparable to mounting brackets 19 and 20, and also adjacent bucket side walls 48 and 49 comparable to bucket side walls 12 and 13. Tooth-like sections 44 and 45 are reinforced in position on the rear wall of the bucket by means of an intermediate reinforcing plate 50 and a pair of laterally disposed reinforcing plates 51 and 52. Intermediate reinforcing plate 50 rigidly interconnects tooth-like sections 44 and 45, is rigidly secured to the bucket rear wall and is provided with a concavely curved rear edge 50*a*. Lateral reinforcing plate 52 rigidly interconnects another surface of section 45 and the bucket rear wall and is provided with a concavely curved edge 52*a*. Similarly, lateral-reinforcing plate 51 interconnects another side of tooth-like section 44 and the bucket rear wall and is provided with a concavely curved edge 51*a*.

FIGS. 3 through 6 illustrate the manner in which bucket 10 is mounted on the handle of an excavating machine, and various positions of the bucket in performing a ripping and scooping operation. In particular, there is shown a handle 60 typically connected to the upper end of the boom of an excavating machine or the like (not shown) by means of a connecting pin 61, and an actuating assembly 62. Bucket 11 is typically connected to the free end of handle 60 by means of a connecting pin 64 extending through aligned openings 22, 22 of the bucket mounting brackets and an opening in the end of the handle, and to actuating assembly 62 by means of a connecting pin 63 extending through aligned openings 21, 21 of the bucket mounting brackets and an opening in an actuating link 65 of the actuating assembly. The actuating assembly essentially consists of a hydraulic cylinder assembly 66, a support link 67 and actuating link 65. Support link 67 is pivotally connected to handle 60 by means of connecting pin 68 and is connected to a free end of actuating link 65 by means of a connecting pin 69. Cylinder assembly 66 includes a cylinder member 70 pivotally connected at its base end to a bracket 71 mounted on an upper side of the handle by means of a connecting pin 72, and a rod member 73 connected at its free end to connecting pin 69. It will be appreciated that by extending and retracting rod member 73 of the cylinder assembly, motion will be transmitted to the bucket to cause it to pivot or curl and uncurl about the axis of connecting pin 63 to assume various angular positions relative to the handle, as shown in FIGS. 3 through 6.

Figure 4:
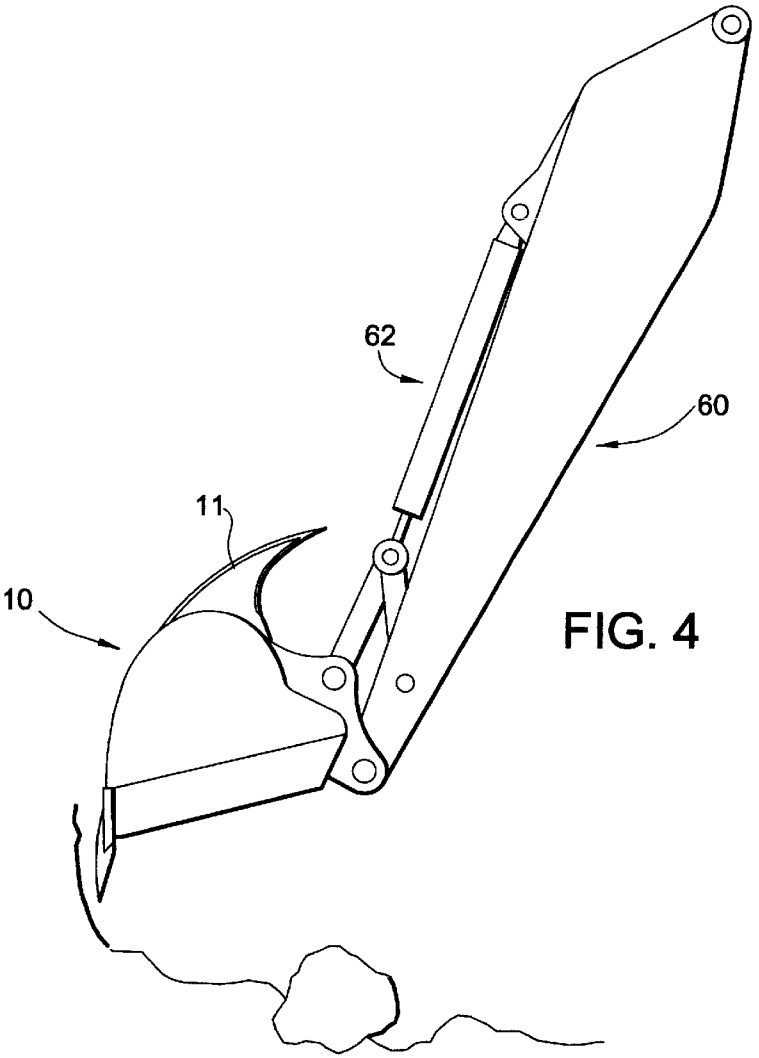
FIG. 4 is a view similar to the view shown in FIG. 3, illustrating the bucket in a fully uncurled position.
Figure 3:
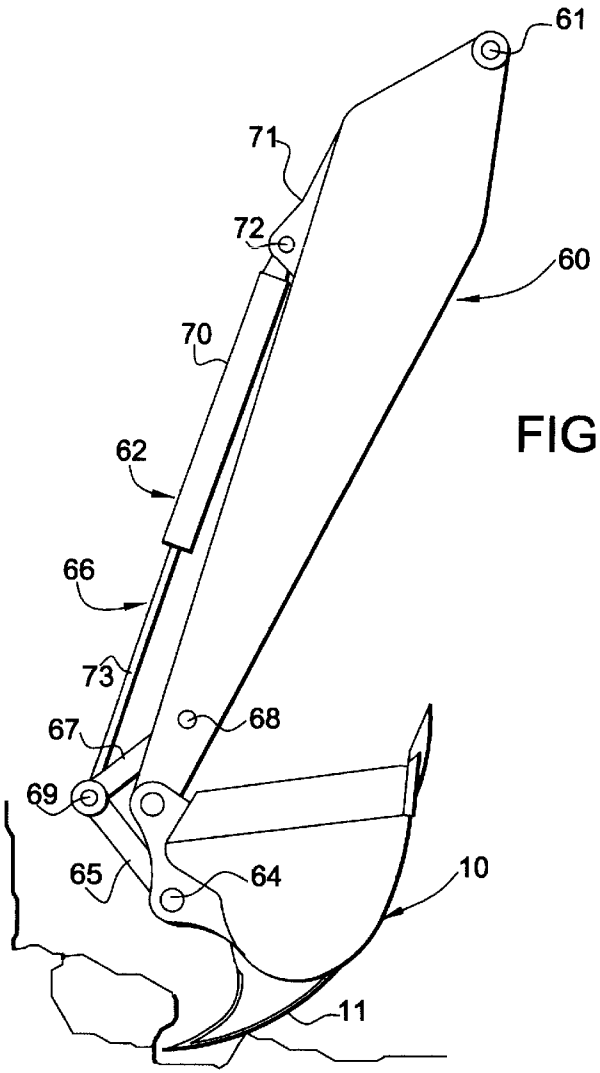
FIG. 3 is a side elevational view of the bucket shown in FIGS. 1 and 2, mounted on a machine handle and illustrating the bucket in a fully curled position.
Figure 6:
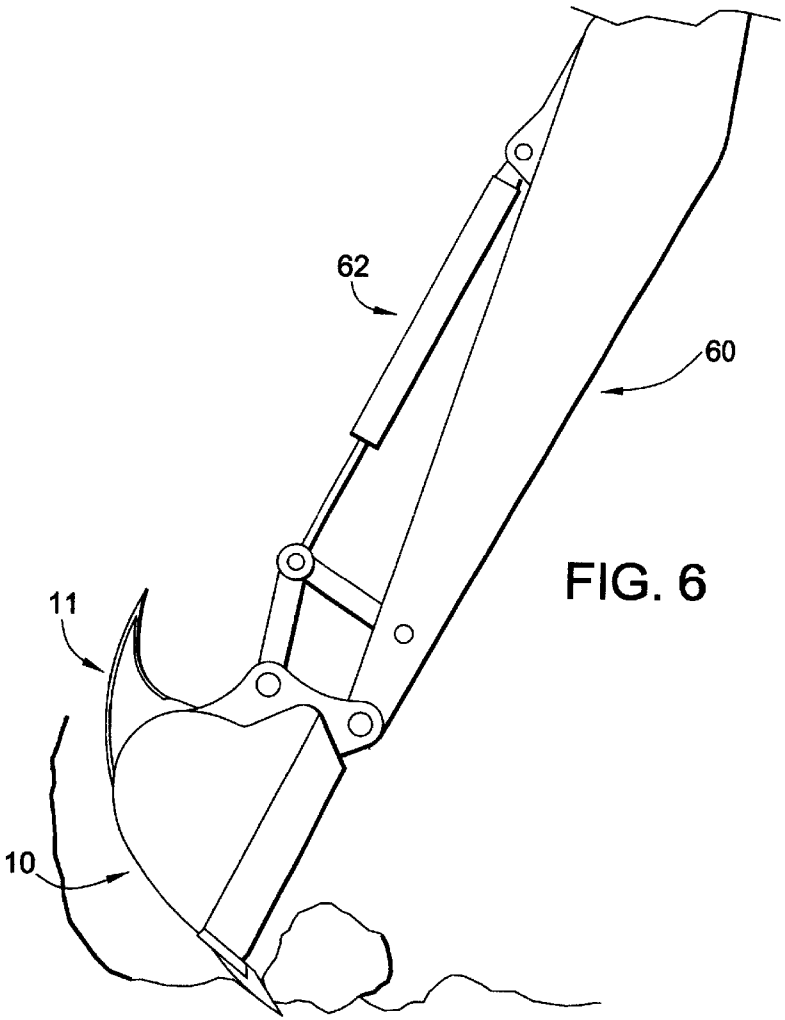
FIG. 6 is a view similar to the view shown in FIG. 3, illustrating the bucket in a partially curled position.
Figure 5:
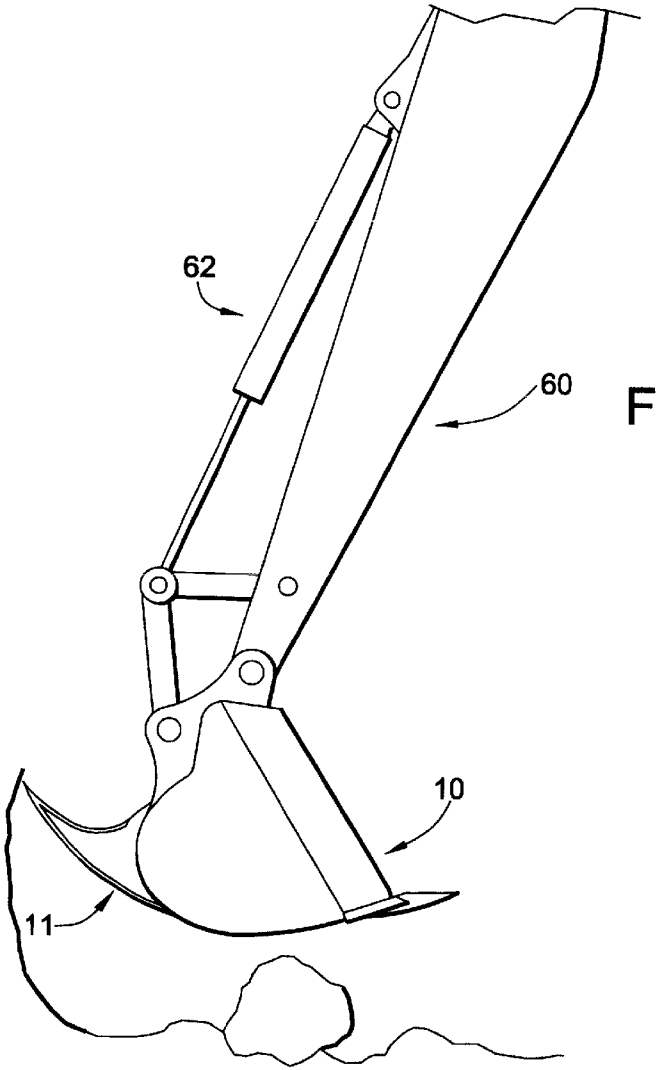
FIG. 5 is a view similar to the view shown in FIG. 3, illustrating the bucket in a partially uncurled position.

In the use of the bucket as described to penetrate and break up a hard surface of material and remove it, cylinder assembly 62 is first operated to extend the rod member thereof and thus cause the bucket to fully curl to a position as shown in FIG. 3, the handle of the machine is maneuvered to position the point of the ripping element adjacent the hard material and then the cylinder assembly is operated to uncurl the bucket to the position shown in FIG. 4, causing the ripping implement to penetrate and break up the hard material as the bucket is uncurled. The cylinder assembly may then be extended and the handle maneuvered to cause the bucket to curl and thus scoop up the broken material. When the bucket has scooped a load of fractured material and is returned to its fully curled position, the handle may be maneuvered to position the bucket above a material hauler or another location where the cylinder assembly may then be operated to uncurl the bucket and thus allow the load of broken material to be dumped.

The configuration of the ripping element, having a lower edge forming a continuation of the rear and bottom walls of the bucket permits the bucket to make pivotal sweeps as it uncurls and curls to break up a hard material being excavated and scoop it up for removal and dumping at another location. The radius of curvature of the outer surfaces of the bottom and rear walls of the bucket and the lower edge of the ripping implement relative to the axis of connecting pin 63 permit such a sweep of the bucket during the ripping and scooping actions of the bucket.

The embodiment of the invention shown in FIG. 1*a* operates in the same manner as described in connection with the embodiment shown in FIGS. 1 and 2. With a pair of ripping implements, an enhanced penetration and fracturing of the hard materials is achieved. Such embodiment has the additional benefit of providing a structure in which the loads imposed between the handle and the ripping implements are transmitted along closely positioned planes of the ripping implements, the side walls of the bucket and the mounting brackets on the upper wall of the bucket.

Figure 7:
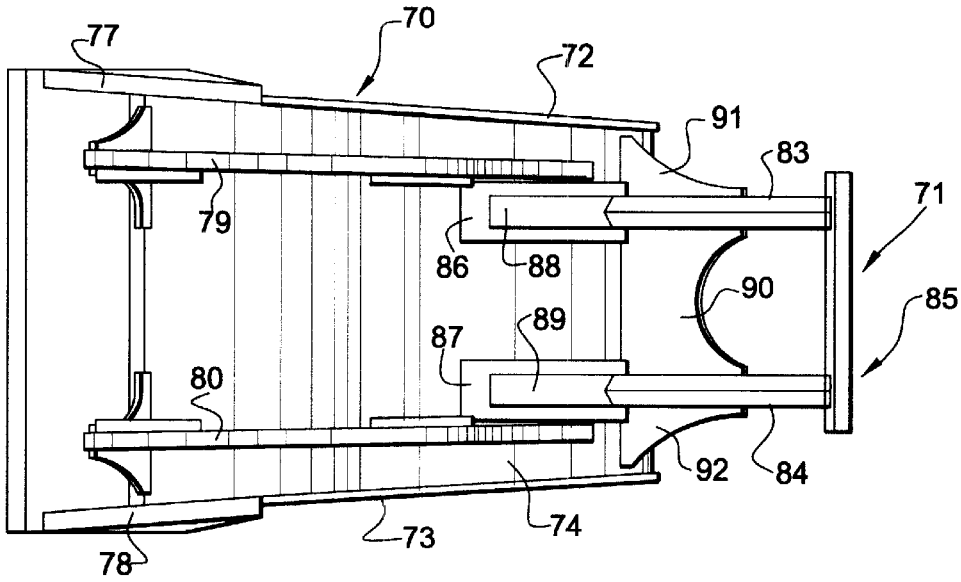
FIG. 7 is a top plan view of another embodiment of the invention.
Figure 8:
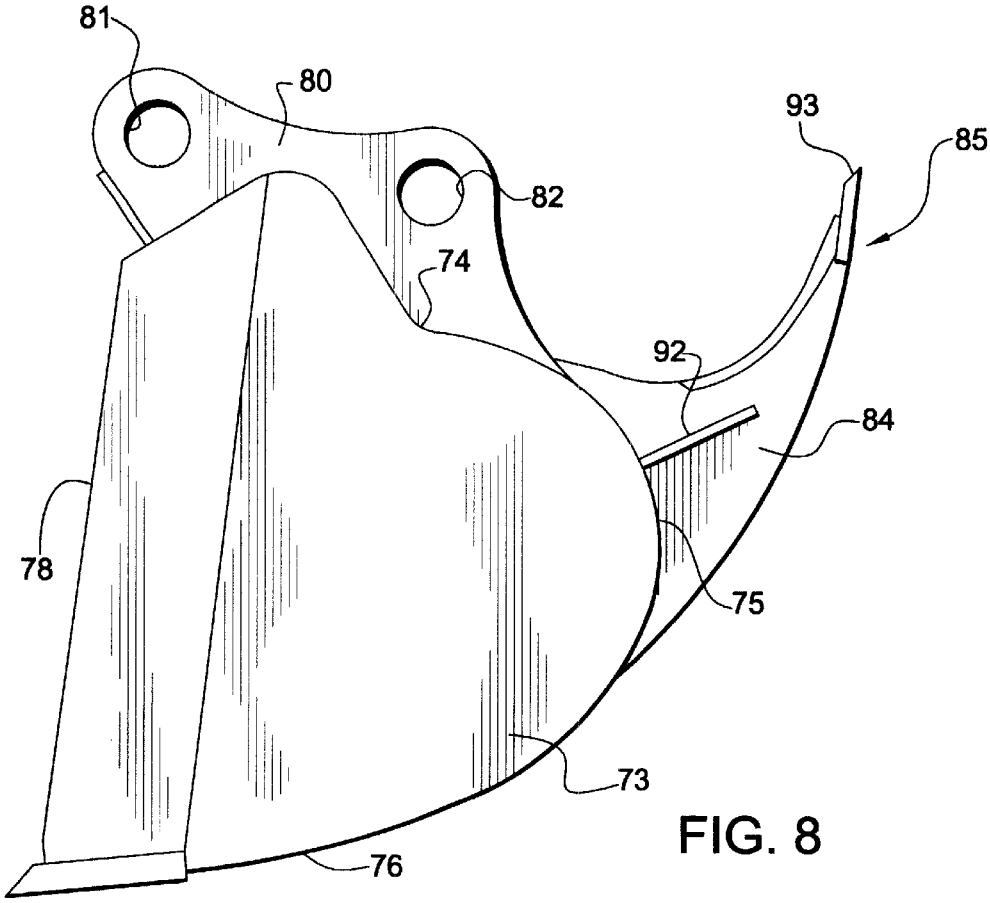
FIG. 8 is a side elevational view of the embodiment shown in FIG. 7.

FIGS. 7 and 8 illustrate another embodiment of the invention which consist of a bucket 70 equipped with a ripping implement 71. The bucket includes a pair of longitudinally disposed, transversely spaced side walls 72 and 73, an upper wall 74, a curved rear wall 75 and a curved bottom wall 76. The side walls are transversely spaced, converging slightly toward the rear wall and are provided with a pair of forwardly disposed cutting edges 77 and 78. Upper wall 74 rigidly interconnects the upper ends of side wall 72 and 73 and further is provided with a pair of longitudinally disposed, transversely spaced mounting brackets 79 and 80. such brackets are positioned adjacent the side walls and are provided with a first set of transversely aligned openings 81 and 81 and a second set of transversely aligned openings 82, 82 for detachably connecting the bucket to the handle of the machine in a manner as previously described in connection with the aforementioned embodiments of the invention. Rear wall 75 forms a continuation of the rear end of the upper wall and is provided with a curvature which merges smoothly with the curvature of the lower wall. Ripping implement 71 is secured to rear wall 75 and consists of a pair of longitudinally disposed, transversely spaced members 83 and 84 rigidly secured at their base ends of rear bucket wall 75 and a transversely disposed blade member 85. Members 83 and 84 are similar in form and function to implements 40 and 41 and also are disposed adjacent mounting brackets 79 and 80. They include base sections 86 and 87, projecting sections 88 and 89, respectively, and reinforcing plates 90, 91, and 92. Projecting sections 83 and 84 have tooth-like configurations and include upper and lower sharpened edges to facilitate penetration of the implement into an embankment of hard material to be broken up. Blade member 5 consists of a plate of high tensile steel welded onto the ends of the tooth-like sections 83 and 84, and has a beveled, sharpened cutting edge 93.

The bucket and attached implement shown in FIGS. 7 and 8 is adapted to be mounted and operated on the handle of an excavator in a manner similar to the manner described in connection in the previous embodiments. In addition to providing tooth-like elements for breaking up hard soil, such tooth-like members may be used to sever root systems of trees in felling trees and removing their stumps. Such tooth-like members working in conjunction with the blade member of the implement are particularly effective in severing root systems on three sides of a tree to further facilitate the felling of a tree and the removal of the tree stump.

It is contemplated that the embodiments of the invention described be fabricated out of plate and/or castings welded together using conventional fixturing and welding techniques. Cutting edges of the side walls of the bucket and in the lower transverse cutting edge of the bucket wall may be formed of a high tensile steel. If further is contemplated within the scope of the invention that the buckets be formed with one or more of the ripping elements as described or that the ripping elements be manufactured and sold separately so that they may be separately mounted on conventional buckets in service. Such separate units would be formed with mounting plate sections having curvatures complementary with the curvatures of standard excavating buckets with or without reinforcing plates.

From the foregoing detailed description, it will be evident that there are a number of changes, adaptations and modifications of the present inventions which come within the province of those having ordinary skill in the art to which the aforementioned invention pertains. However, it is intended that all such variations not departing from the spirit of the invention be considered as within the scope thereof as limited solely by the appended claims.

I claim:

1. An excavating bucket mountable on the handle of machine, comprising:

a pair of side walls;

an upper wall interconnecting said side walls;

a downwardly and forwardly curved rear wall merging into a forwardly curved bottom wall, interconnecting said side walls and providing a transversely disposed cutting edge;

at least one ripping tooth mounted on said rear wall, projecting rearwardly and having a curved lower edge merging with the curvature of said rear and bottom walls to provide a substantially continuous curved line; and means for detachably connecting said bucket to said handle.

2. An excavating bucket according to claim 1 wherein said tooth is provided with a curved upper edge.

3. An excavating bucket according to claim 1 wherein said tooth lies in a plane disposed substantially parallel to and between said side walls.

4. An excavating bucket according to claim 1 including a reinforcing plate disposed on each side of said tooth between said rear wall and said tooth.

5. An excavating bucket according to claim 4 wherein each of said reinforcing plates is provided with a concavely curved edge.

6. An excavating bucket according to claim 1 including two of said ripping teeth.

7. An excavating bucket according to claim 6 wherein each of said teeth is provided with a curved upper edge.

8. An excavating bucket according to claim 6 wherein each of said teeth lies in a plane disposed substantially parallel to and between said side walls.

9. An excavating bucket according to claim 6 including a reinforcing plate disposed between said teeth and secured to said rear wall and a reinforcing plate disposed between an outer side of each tooth and said rear wall.

10. An excavating bucket according to claim 9 wherein each of said reinforcing plates is provided with a concavely curved edge.

11. An excavating bucket according to claim 6 including a transversely disposed blade member rigidly interconnecting said teeth.

12. An excavating bucket according to claim 11 in which said blade member includes a sharpened cutting edge.

13. An excavating bucket according to claim 11 wherein each of said teeth lies in a plane substantially parallel to and between said side walls.

14. An excavating bucket according to claim 11 including a reinforcing plate disposed between said teeth and secured to said rear wall and a reinforcing plate disposed between an outer side of each tooth and said rear wall.

15. An excavating bucket according to claim 1 wherein said means for detachably connecting said bucket to said handle includes a pair of brackets mounted on said upper wall, lying in planes disposed substantially parallel to and between said side walls, and including a pair of said teeth, each disposed adjacent one of said bracket.

16. An excavating bucket according to claim 15 wherein each of said brackets is disposed adjacent one of said side walls wherein loads imposed between said teeth and said brackets at least partially are transmitted through said side walls.

17. An excavating bucket according to claim 15 wherein said brackets include a pair of sets of transversely aligned openings for receiving pins therethrough for connecting said bucket to said handle.

18. An excavating bucket according to claim 1 wherein said means for detachably connecting said bucket to said handle includes a pair of brackets mounted on said upper wall, lying in planes disposed substantially and parallel to and between said side walls, and including a pair of said teeth, each disposed adjacent one of said brackets, and a transversely disposed blade member rigidly interconnecting said teeth.

19. A ripping implement mountable on an excavating bucket connectable to the handle of a machine, having a downwardly and forwardly curved rear wall merging into a forwardly curved bottom wall, comprising:

a tooth-shaped member mountable on said rear wall, having a curved base surface provided with a radius of curvature complementary with a portion of said rear and bottom walls of said excavating bucket to provide a substantially continuous curved line when said tooth-shaped member is mounted on said rear wall.

20. ripping implement according to claim 19 when said tooth-shaped member includes a curved upper edge.

21. A ripping implement according to claim 19 wherein said tooth-shaped member includes a reinforcing plate secured to each side of said member and attachable to said rear wall of said bucket when said tooth-shaped member is mounted on said rear wall of said bucket.

22. A ripping implement according to claim 21 wherein said reinforcing plate includes a concavely curved edge.

23. A ripping implement mountable on a bucket connectable to the handle of a machine, having a downwardly and forwardly curved rear wall merging into a forwardly curved bottom wall, comprising:

a pair of transversely spaced, tooth-shaped members mountable on said rear wall, each having a curved base surface provided with a radius of curvature complementary with a portion of said rear wall, and a curved lower edge merging with the curvature of said rear and bottom walls of said bucket to provide a substantially continuous curved line when said members are mounted on said rear wall; and means for rigidly interconnecting said members.

24. A ripping implement according to claim 23 wherein said interconnecting means comprises a reinforcing plate attachable to said rear wall and having a concavely curved edge.

25. A ripping implement according to claim 23 wherein each of said tooth-shaped members is provided with a curved upper edge.

26. A ripping implement according to claim 23 including a reinforcing plate rigidly secured to an outer side of each of said tooth-shaped members and rigidly attachable to said rear wall.

27. A ripping implement according to claim 26 wherein said reinforcing plate is provided within a concavely curved edge.

28. A ripping implement mountable on an excavating bucket connectable to a handle of a machine, having a downwardly and forwardly curved rear wall merging into a forwardly curved bottom wall, comprising:

a pair of transversely spaced, tooth-shaped members mountable on said rear wall, each having a curved base surface provided with a radius of curvature complimentary with a portion of said rear wall, and a curved lower edge merging with a curvature of said rear and bottom walls of said bucket to provide a substantially continuous curved line when said members are mounted on said rear wall; and a transversely disposed blade member rigidly interconnecting said tooth-shaped members.

29. A ripping implement according to claim 28 wherein each of said tooth-shaped members is provided with a curved upper edge.

30. A ripping implement according to claim 28 including reinforcing means rigidly interconnecting said tooth-shaped members.

* * * * *